United States Patent [19]

Jorigny et al.

[11] 3,976,180

[45] Aug. 24, 1976

[54] MATRIX PRINTER COMPRISING ONE OR MORE STACKABLE GROUPS OF PRINTING WIRES

[75] Inventors: Gerard Andre Jorigny, Villiers-sur-Marne; Jacques Royer, Vincennes; Georges Edmond Trichard, Chennevieres-sur-Marne, all of France

[73] Assignee: U.S. Philips Corporation, New York, N.Y.

[22] Filed: July 10, 1974

[21] Appl. No.: 487,017

[30] Foreign Application Priority Data

Apr. 9, 1973 France ..... 73.12671

[52] U.S. Cl. ..... 197/1 R; 101/93.05

[51] Int. Cl.[2] ..... B41J 1/18

[58] Field of Search ..... 197/1 R; 101/93.05

[56] References Cited

UNITED STATES PATENTS

| | | | |
|---|---|---|---|
| 2,869,455 | 1/1959 | Knutsen | 101/93.05 X |
| 3,018,722 | 1/1962 | Saltz et al. | 101/93.05 |
| 3,584,575 | 6/1971 | Distl | 197/1 R X |
| 3,672,482 | 6/1972 | Brumbaugh et al. | 197/1 R |
| 3,795,298 | 3/1974 | Kodis | 197/1 R |

FOREIGN PATENTS OR APPLICATIONS

| | | | |
|---|---|---|---|
| 1,405,348 | 5/1964 | France | 197/1 R |

*Primary Examiner*—Ralph T. Rader
*Attorney, Agent, or Firm*—Frank R. Trifari

[57] ABSTRACT

A matrix printer comprising one or more identical groups of printing wires which are guided in ducts in stackable plates of synthetic material. In the case of a plurality of stacked groups, the distance at the area of the printing ends of the wires between two adjacent ducts in two different groups equals the distance between two adjacent ducts of the same group. Different paper widths can be accomodated and characters of different dimensions, curves, patterns and so-termed negative characters can be printed without movement of the groups.

3 Claims, 3 Drawing Figures

MATRIX PRINTER COMPRISING ONE OR MORE STACKABLE GROUPS OF PRINTING WIRES

Figure 1:
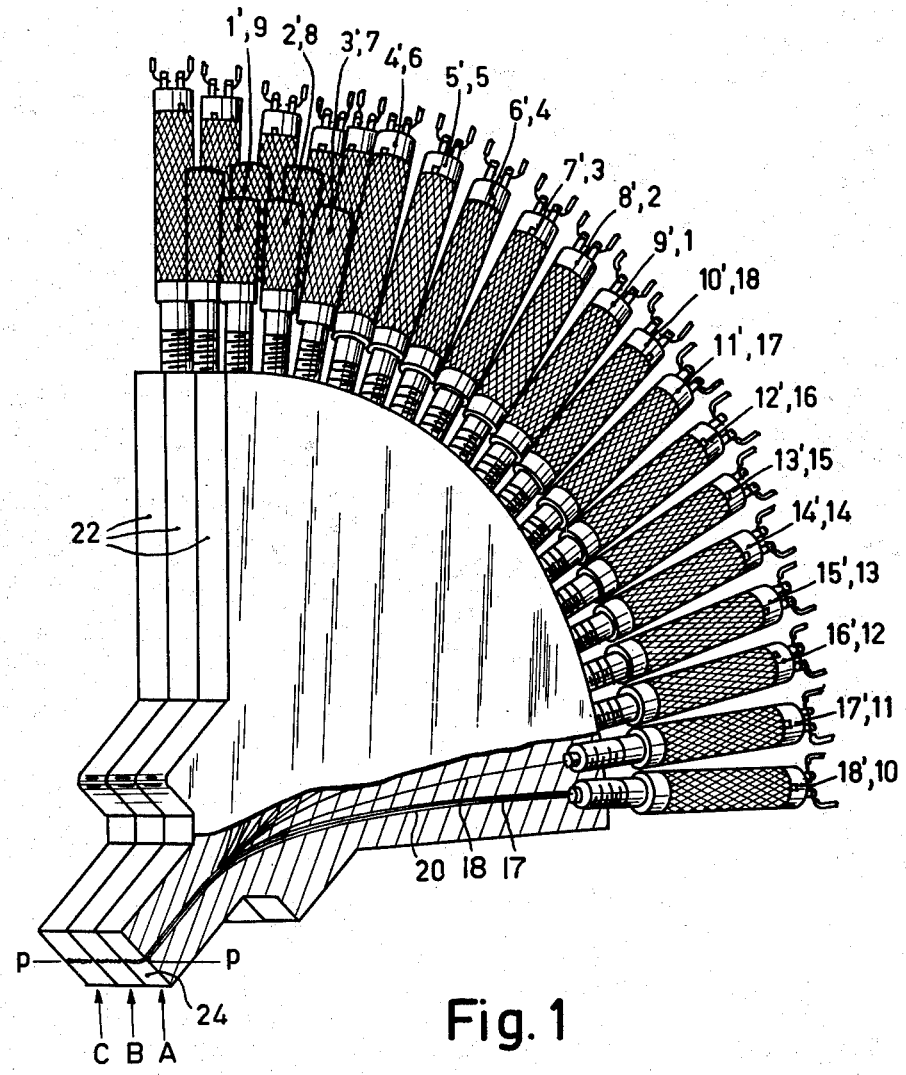

The invention relates to a matrix printer comprising one or more identical groups of at least nine printing wires. The printing wires have print ends disposed in aligned coplanar relation and opposite ends which extend radially within each group from their printing ends towards a plurality of electromagnets each electromagnet is individually associated with one of the printing wires. The center lines of the electromagnets are disposed in the same plane as and in the other end of the wires. The printing ends of the wires are disposed at the same distance from each other and symmetrically with respect to the plane, on the same line which is transverse to the plane through the center lines of the electromagnets.

A known matrix printer of the kind set forth (French Pat. Specification No. 1,405,348) comprises a number of stacked groups, each group comprising three distinct series of five printing wires. Within such a series the printing ends of the wires are situated at the same distance from each other. The minimum distance between two printing ends of two successive series equals the spacing between the columns to be printed, which is substantially larger than the distance between two adjacently arranged printing ends of a series.

The described matrix printer has a restriction in that only characters of a given width can be printed, i.e. four times the center-to-center distance of the printing wires. The printing of characters of different dimension is not possible without displacement of the printing head in a direction transverse to the transport direction of the record carrier.

The invention has for its object to eliminate this restriction and is characterized in that the printing wires of a group are individually guided in ducts which fan out in a plate-like body of synthetic material. The thickness of the material equals the product of the number of ducts in a group and the center-to-center distance of the ducts at the area of the printing ends of the wires. The electromagnets have a dimension perpendicular to the plane through their centre lines which is no greater than the thickness of the body of synthetic material. One end of each electromagnets is provided with a threaded surface by means of which the electromagnet is secured in an opening in the body of synthetic material, aligned with the relevant guide duct. If more than one group of wires is included the relevant bodies of synthetic material are stacked such that the printing ends of all wires are situated on the same line at the same distance from each other.

The invention has furthermore for its object to provide a matrix printer by means of which curves, lines, patterns or fields can be printed.

To this end, a special embodiment of the matrix printer according to the invention is characterized in that at the area of the printing ends the distance between adjacent ducts equals 0.07 mm.

The invention will be described in detail hereinafter with reference to the drawing.

Figure 2:
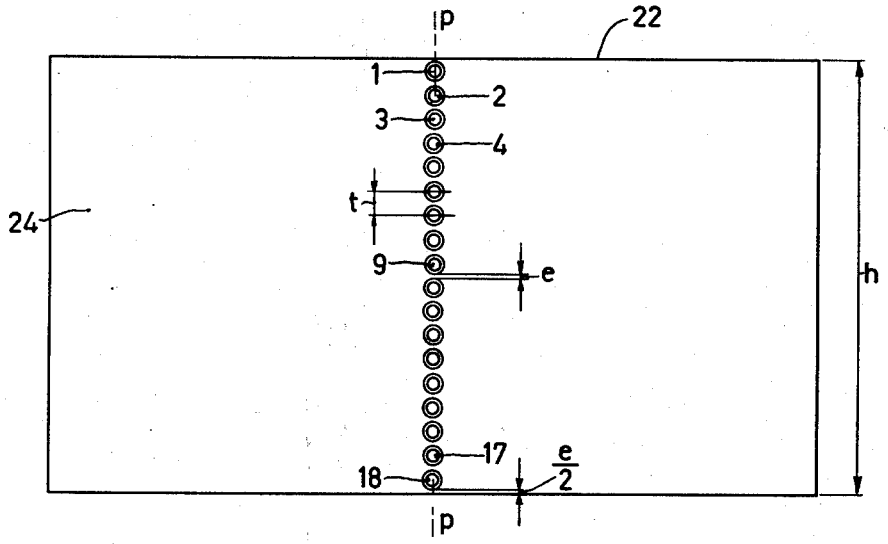
Figure 3:
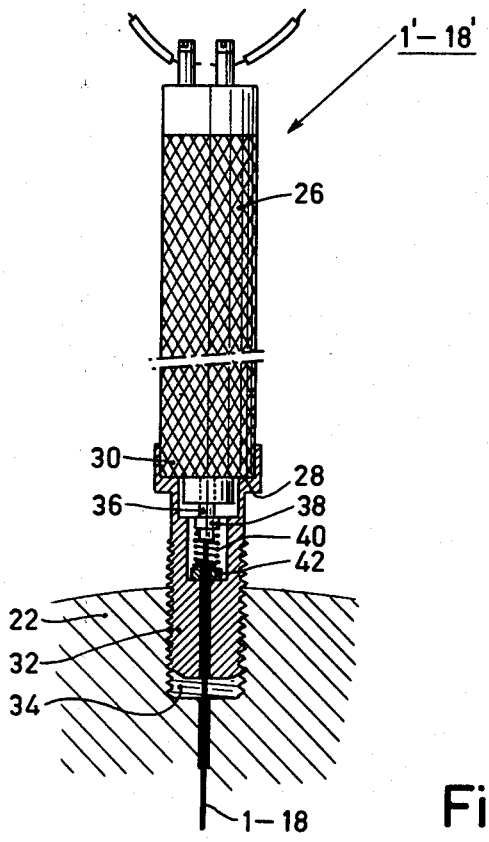

FIG. 1 is a perspective front view of a part of a matrix printer according to the invention, comprising three groups of eighteen printing wires, FIG. 2 is a front view at an enlarged scale of the printing ends of the printing wires in a matrix printer as shown in FIG. 1, and FIG. 3 is a sectional view of the fastening of the electromagnets in a matrix printer as shown in FIG. 1.

The part of the matrix printer according to the invention which is shown in FIG. 1 comprises the printing head which is to supported in stationary relation with respect to a record carrier. The record carrier and the ink ribbon and their transport devices are of the usual kind and have been omitted for the sake of clarity. The printing head shown in FIG. 1 comprises three identical groups A, B and C, each group comprising eighteen printing wires 1 to 18 which fan out from their printing ends, situated at the same distance from each other, towards eighteen circle-cylindrical electromagnets 1' to 18' which are arranged along a circle circumference at the same distance from each other. The ends of the printing wires 1 to 18 which are remote from the printing ends are secured to the armatures of the electromagnets 1' to 18' which are not visible in FIG. 1 (see FIG. 3). In the FIGS. 1 and 2 references are used so as to indicate to which electromagnet a given printing wire is connected. For example, the armature of electromagnet 18' (see FIG. 1) is coupled to printing wire 10 (see FIG. 2). The further construction of the printing head with the groups A, B and C will be described in detail hereinafter on the basis of the group A which is best visible in FIG. 1.

The printing wires 1 to 18 are guided over their full length in ducts 20 which are provided in a plate of synthetic material 22 and which have a circular cross-section (see also FIG. 2). At the area of the connection to the printing wires the center lines of each of the electromagnets 1' to 18' is disposed in coaxial relation to one of the printing wires. The centre lines of the electromagnets are also situated in one plane through the center of and parallel to the center plate of synthetic material 22 and center plane thereof. The printing wires 1 to 18 and the ducts 1' to 18' are situated for approximately ninety per cent of their length in the center plane. Near the location which is defined by the center of the circular arc on which the electromagnets are situated, the printing wires are bent such that they extend parallel to each other over approximately ten per cent of their length up to their printing end and are situated in a plane (transverse plane) which is perpendicular to the center plane. For the said ten per cent of their length the printing wires are, moreover, situated at the same distance from each other and also symmetrical with respect to the center plane. The printing ends of all wires are situated on the same line p-p which is perpendicular to the center plane and is situated in the transverse plane. The electromagnets 1' to 18' are adjustably secured to the plate of synthetic material 22 by way of a threaded fastening. The fastening of the electromagnets will be discussed in detail hereinafter with reference to FIG. 3. The wires whose printing ends are situated near the center plane are connected to the outermost electromagnets, and the wires whose printing ends are situated further from the center plane are connected to the innermost electromagnets (see FIG. 1). The wires 1 to 18 all have the same length. The eighteen ducts for the wires have a slightly different length with respect to each other. Adjustment of the electromagnets ensures that the printing ends of the wires are situated on the line p-p. A partition of synthetic material having a uniform thickness e, in the direction of the line p-p, is disposed between adjacent ducts at the area of the printing ends (see FIG. 2), with the result that the printing ends are symmetrical with respect to the center plane. The ducts associated with the printing wires 1 and 18 are separated at the area of the printing ends by a partition having a thickness ½ e from the relevant end faces of the plate 22, again viewed in the direction of the line p-p. The thickness *h* of the plate 2 is, consequently, equal to 18 (e+d), *d* being the diameter of the ducts. If the center-to-center distance between adjacent wires is assumed to equal *t*, the thickness *h* of the plate equals 18 t. In the embodiment shown in FIG. 1:

the length of the wires equals 120 mm,
the diameter of the wires equals 0.38 mm,
the diameter of the ducts equals 0.40 mm,
the distance *e* equals 0.07 mm,
the distance *t* equals 0.47 mm,
the thickness *h* equals 8.46 mm.

As was already stated, the groups A, B and C are identical, so that when the three plates 22 are stacked, a printing head as shown in FIG. 1 is obtained comprising 54 printing wires which are all situated on the line p—p. The distance between two adjacent ducts of different groups (A and B, or B and C) equals *e*, like the distance between two adjacent ducts of the same group. Consequently, using the printing head shown in FIG. 1 a paper width of 25.24 mm can be printed. The printing head is then arranged to be stationary the paper being transported in a direction perpendicular to the line p—p.

The plates A, B and C are connected to each other by clamps or brackets (not shown for the sake of clarity).

The electromagnets shown in FIG. 1 are secured to the plates 22 in a manner as shown in detail in FIG. 3. Each of the electromagnets 1' to 18' comprises a circle-cylindrical housing 26 which is glued, by way of a part of an end face 28 and a part of its outer jacket 30, in a screw 32 which is provided with a cup for this purpose. The screw 32 is screwed into a threaded hole 34 which is provided in the plate 22. The armature 36 of the electromagnet (1' – 18') is connected to the relevant printing wire (1 – 18) in a usual manner. On the armature 36 a shoulder 38 is formed on which a reset spring 40 bears. Furthermore, the screw 32 comprises a centring member 42 for the spring 40. The depth of the hole 34 and the length of the thread provided therein have been chosen such that the difference in length of the guide ducts for the printing wires can be compensated for by screwing the screw 32 in or out. Moreover, the wear on the printing end of a wire can be compensated for by screwing the screw 32 further into the hole 34.

The number of groups of printing wires constituting a matrix printer according to the invention is not restricted to three. Depending on the paper width to be printed or on the desired dimension of the characters to be printed, the number of groups can be increased or reduced. The dimension (matrix) of the characters to be printed can also be varied by increasing or decreasing the number of printing positions per character in the direction perpendicular to the line p-p. This can be effected by adaptation of the control electronics of the printer. The printing head shown in FIG. 1 is particularly suitable for printing comparatively narrow strips (so-termed flight strips) which are often used in flight control centers on airports (reading direction in the longitudinal direction of the strips). Because the distance between the ducts for the printing ends is only 0.07 mm, the matrix printer shown is also suitable for printing so-termed negative characters. Such characters are characterized in that they have the same color as the record carrier, while the field in which the character is placed in contrast has the colour of the pigment of the ink ribbon or the paper. For this purpose, a minimum number of nine printing wires per group is required. This will be readily understood on the basis of the seven by five matrix which is most often used in matrix printing. For example, if the letter E is to be printed, at least two points to the left and the right of the horizontal lines in this character are required so as to obtain adequate background for the character. Finally, using a matrix printer in which the distance between the ducts is only 0.07 mm, curves and patterns can be printed which appear to be uninterrupted.

The use of synthetic material for the plates 22 on the one hand enables the comparatively simple and cheap manufacture of a series of printers for different character dimensions which have the same production process on account of the modular construction, while on the other hand the wires can be arranged at a comparatively small distance from each other.

suitable synthetic materials are, for example, mouldable resins such as epoxy, polyimide and polyester resins. These resins can contain a filler which can inter alia serve to reduce the friction coefficient or to increase the heat conductivity. such fillers are, for example, graphite, a mixture of graphite and polytetrafluoroethylene, and molybdenum bisulphide.

In order to enhance the discharging of heat from the electromagnets when the matrix printer is in operation, plates 22 can be used in which the electromagnets are arranged to be asymmetrical. When such plates are stacked in a mirrorimaged manner with respect to each other, the row of electromagnets of the one group will be situated exactly between the row of magnets of the group stacked directly thereon. Adequate clearance then remains between the electromagnets of the different groups so as to ensure the proper discharging of heat.

We claim:

1. A matrix printer which comprises a plurality of modules in a side by side contacting arrangement, each module comprising a plurality of printing wires, each printing wire having a printing end and an other end, each printing end of said plurality of printing wires in each module being disposed in a first plane in parallel relationship with uniform spacing between adjacent wires; each module comprising a synthetic material housing carrying and guiding said wires; a plurality of electromagnets carried by each said synthetic material housing, one of said electromagnets engaging said other end of each of said wires remote from said printing end and selectively axially displacing said wire for printing, said electromagnets and said other ends of said wires being disposed in a second plane, said first and second planes in each module being disposed in perpendicular relation, each synthetic material housing having a thickness dimension measured in said first plane equal to the number of wires disposed in each of said modules times the center to center distance between adjacent wires, said electromagnets having a thickness measured in a plane parallel to said first plane no greater than said thickness dimension of said synthetic material housing, each of said first planes being disposed in coplanar relation for said plurality of modules within said matrix printer, said plurality of printing wires in each module being disposed equidistant measured in said first plane from the extremities of said module whereby adjacent printing ends in adjacent modules are disposed with the same center to center spacing as the center to center spacing of the printing ends within the same module.

2. The apparatus as described in claim 1 wherein said modules have two generally planar faces disposed in parallel relationship to the plane in which said other ends of said printing wires are disposed.

3. The apparatus as described in claim 2, wherein said modules are mounted in a stationary manner and said apparatus includes means for moving an associated record carrier in a direction transverse to said first plane.

* * * * *